US012351997B2

(12) United States Patent
Li et al.

(10) Patent No.: US 12,351,997 B2
(45) Date of Patent: Jul. 8, 2025

(54) CORRUGATED PIPE CONNECTION DEVICE FOR CONTINUOUS SECTION AT TOP OF CONTINUOUS T-SHAPED BEAM BRIDGE PIER AND USAGE METHOD

(71) Applicant: SHANDONG JIAOTONG UNIVERSITY, Shandong (CN)

(72) Inventors: Jin Li, Jinan (CN); Guangbo Liu, Jinan (CN); Fengkun Cui, Jinan (CN); Xu Dong, Jinan (CN); Xinzhuang Cui, Jinan (CN)

(73) Assignee: SHANDONG JIAOTONG UNIVERSITY, Jinan (CN)

( * ) Notice: Subject to any disclaimer, the term of this patent is extended or adjusted under 35 U.S.C. 154(b) by 322 days.

(21) Appl. No.: 17/768,648

(22) PCT Filed: Jan. 4, 2021

(86) PCT No.: PCT/CN2021/070156
§ 371 (c)(1),
(2) Date: Apr. 13, 2022

(87) PCT Pub. No.: WO2021/203782
PCT Pub. Date: Oct. 14, 2021

(65) Prior Publication Data

US 2024/0110345 A1 Apr. 4, 2024

(30) Foreign Application Priority Data

Apr. 8, 2020 (CN) ..... 202010269339.7

(51) Int. Cl.
*E01D 19/00* (2006.01)
*E01D 19/02* (2006.01)
*E01D 21/00* (2006.01)

(52) U.S. Cl.
CPC ..... *E01D 19/02* (2013.01); *E01D 21/00* (2013.01)

(58) Field of Classification Search
CPC ..... E01D 19/02; E01D 21/00
(Continued)

(56) References Cited

U.S. PATENT DOCUMENTS 6,668,412 B1 * 12/2003 Tadros ..... E01D 19/125 14/73.1
7,334,963 B2 * 2/2008 Costa ..... E01C 11/14 14/73.1
(Continued)

FOREIGN PATENT DOCUMENTS

CN 202442034 U 9/2012
CN 204459556 U 7/2015
(Continued)

OTHER PUBLICATIONS

Mar. 22, 2021 Office Action and Search Report issued in Chinese Patent Application No. 202010269339.7.
(Continued)

*Primary Examiner* — Raymond W Addie
(74) *Attorney, Agent, or Firm* — Oliff PLC

(57) ABSTRACT

A corrugated pipe connection device for a continuous section at the top of a continuous T-shaped beam bridge pier. The connection device includes a combined steel pipe telescopic device and a corrugated pipe connector, the interiors being hollow; the connector includes a first clamping member for clamping a wall surface of a corrugated pipe; one end of the telescopic device is a second clamping member with the same structure as the first; the other end is a telescopic steel pipe which is telescopic in the length direction; and the telescopic steel pipe is connected to the connector. The device replaces a corrugated pipe between
(Continued)

two T-shaped beams, thereby avoiding problems such as breakage and slurry leakage caused by an original construction mode. The device can stretch out and draw back according to a distance between the T-shaped beams, and steel strands can be stranded by means of a stranding machine.

10 Claims, 1 Drawing Sheet

(58) Field of Classification Search
USPC ..... 14/75, 77.1, 78
See application file for complete search history.

(56) References Cited

U.S. PATENT DOCUMENTS

| | | | | |
|---|---|---|---|---|
| 7,395,570 | B2 * | 7/2008 | Bradford | E01D 19/062 14/73.1 |
| 2011/0225746 | A1 * | 9/2011 | Desrochers | E01D 19/086 14/73.1 |
| 2021/0054583 | A1 * | 2/2021 | Wang | E04C 5/0604 |

FOREIGN PATENT DOCUMENTS

| | | | | | |
|---|---|---|---|---|---|
| CN | 204959580 | U | | 1/2016 | |
| CN | 205369039 | U | | 7/2016 | |
| CN | 209443778 | U | | 9/2019 | |
| CN | 209671857 | U | | 11/2019 | |
| CN | 110593096 | A | | 12/2019 | |
| CN | 210127403 | U | | 3/2020 | |
| CN | 111424552 | A | | 7/2020 | |
| CN | 110593096 | B | * | 9/2021 | E01D 19/12 |
| DE | 10009243 | A1 | | 9/2000 | |
| JP | H08-284188 | A | | 10/1996 | |
| JP | H11-8282 | A | | 1/1999 | |
| JP | 3204298 | U | | 5/2016 | |

OTHER PUBLICATIONS

Apr. 6, 2021 International Search Report issued in International Patent Application No. PCT/CN2021/070156.

Apr. 6, 2021 Written Opinion of the International Searching Authority issued in International Patent Application No. PCT/CN2021/070156.

* cited by examiner

CORRUGATED PIPE CONNECTION DEVICE FOR CONTINUOUS SECTION AT TOP OF CONTINUOUS T-SHAPED BEAM BRIDGE PIER AND USAGE METHOD

TECHNICAL FIELD

The present disclosure belongs to the field of bridge construction technologies of civil engineering, and in particular, to a corrugated pipe connection device for a continuous section at the top of a continuous T-shaped beam bridge pier and a usage method.

BACKGROUND

The statements herein provide only the background related to the present disclosure, and do not necessarily constitute the prior art.

In recent years, with the continuous progress of infrastructure construction in China, the continuous T-shaped beam bridge has become one of important bridge types in bridge construction in China due to advantages such as prefabricated beams, fast on-site construction, and easy control of construction quality. However, during the construction of the continuous T-shaped beam bridge, the stranding of steel strands, sealing, and grouting of a continuous section at the top of a pier have become engineering difficulties.

Nowadays, when a construction unit performs stranding for a continuous section at the top of a pier, a reserved corrugated pipe is generally cut, and a stranding machine is used to operate on an erected T-shaped beam. After steel strands are stranded, a tape is used to seal cutting openings, then tensioning and anchoring are performed, and grouting is finally performed. This method is fast in construction speed, but the sealing performance of the tape is poor, and the grouting produces some pressure, which causes slurry leakage, affecting the project quality. If the reserved corrugated pipe is not damaged and the stranding is performed at anchor holes of steel strands, because the anchor holes are located at T-shaped beam webs, there is no operating platform, and the stranding can only be performed manually. This method is slow in construction progress, and the construction is more dangerous.

SUMMARY

For the technical problem in the prior art, the present disclosure provides a corrugated pipe connection device for a continuous section at the top of a continuous T-shaped beam bridge pier and a usage method. The connection device replaces a corrugated pipe of a continuous section at the top of a continuous T-shaped beam bridge pier, and is tightly connected to the corrugated pipe; and a steel pipe thereof can freely stretch out and draw back, thereby resolving the stranding problem of steel strands of the continuous section at the top of the pier.

At least one embodiment of the present disclosure discloses a connection device for corrugated pipes of a continuous T-shaped beam bridge pier top continuous section. The device includes a combined steel pipe telescopic device and a corrugated pipe connector, where interiors of the combined steel pipe telescopic device and the corrugated pipe connector are hollow; the corrugated pipe connector includes a first clamping member used for clamping a wall surface of a corrugated pipe; and one end of the combined steel pipe telescopic device in a length direction is a second clamping member with the same structure as the first clamping member; the other end is a telescopic steel pipe which is telescopic in the length direction; and the telescopic steel pipe is connected to the corrugated pipe connector.

Further, the first clamping member includes a first contact member in contact with an outer wall surface of the corrugated pipe and a second contact member in contact with an inner wall surface of the corrugated pipe.

Further, an inner wall surface of the first contact member is foam with raised particles; and an outer wall surface of the second contact member is with raised rubber pellets, which increases the friction between the second contact member and the corrugated pipe, and improves the connection strength.

Further, the connection device further includes a first rotating member disposed on an outer wall surface of the first contact member and configured to increase a contact force between the first clamping member and the corrugated pipe; an outer surface of the first contact member is provided with an external thread; the first rotating member is a rotating nut; and a diameter of the first contact member in a direction close to the corrugated pipe gradually increases. In this way, the rotating nut rotates to gradually compress the first contact member, to ensure close contact between the first contact member and the corrugated pipe.

Further, the first contact member is a flexible body; and the second contact member is a rigid body.

Further, the telescopic steel pipe includes a plurality of sliding pipes nestedly connected to each other in the length direction; and the sliding pipes stretch out and draw back through rolling of rolling members.

Further, cross sections of the sliding pipes in an axial direction are two U-shaped grooves with vertical openings; and the rolling members are disposed on end portions of two vertical side walls of the U-shaped grooves.

Further, a sliding pipe located on an end portion of the telescopic steel pipe is connected to the corrugated pipe connector.

At least one embodiment of the present disclosure further discloses a usage method for the corrugated pipe connection device for a continuous section at the top of a continuous T-shaped beam bridge pier described above, and the method includes:

- step 1: connecting a corrugated pipe connector to a corrugated pipe on a first T-shaped beam end, and adjusting a first rotating member to squeeze a first clamping member, so that the corrugated pipe is tightly connected to the corrugated pipe connector; and connecting a combined steel pipe telescopic device to a corrugated pipe of a second T-shaped beam end corresponding to the first T-shaped beam end, and adjusting a second rotating member so that a second clamping member squeezes the corrugated pipe on the beam for connection;
- step 2: contracting a telescopic steel pipe on the combined steel pipe telescopic device according to an operating space required by a stranding machine, and stranding steel strands at the top of a pier by using the stranding machine;
- step 3: pulling the combined steel pipe telescopic device, to connect a steel pipe of the combined steel pipe telescopic device close to the corrugated pipe connector to the corrugated pipe connector; and
- step 4: tensioning the steel strands, anchoring anchor heads on the corrugated pipe, and finally grouting.

Beneficial effects of embodiments of the present disclosure are as follows:

(1) The device of the present disclosure replaces a corrugated pipe between two T-shaped beams, thereby avoiding problems such as corrugated pipe breakage and slurry leakage caused by an original construction mode.

(2) The combined steel pipe telescopic device in the device of the present disclosure can freely stretch out and draw back according to a distance between the two T-shaped beams, and steel strands can be stranded by means of a stranding machine.

BRIEF DESCRIPTION OF THE DRAWINGS

The accompanying drawings constituting a part of the present disclosure are used to provide further understanding of the present disclosure. Exemplary embodiments of the present disclosure and descriptions thereof are used to explain the present disclosure, and do not constitute an improper limitation to the present disclosure.

DETAILED DESCRIPTION

It should be noted that the following detailed descriptions are all exemplary and are intended to provide a further understanding to the present disclosure. Unless otherwise specified, all technical and scientific terms used in the present disclosure have the same meaning as commonly understood by a person of ordinary skill in the technical field to which the present disclosure belongs.

In the description of the present disclosure, it should be understood that orientation or position relationships indicated by the terms such as "upper", "lower", "top", "bottom", "inner", and "outer" are based on orientation or position relationships shown in the accompanying drawings, and are used only for ease and brevity of illustration and description of the present disclosure, rather than indicating or implying that the mentioned apparatus or component needs to have a particular orientation or needs to be constructed and operated in a particular orientation. Therefore, such terms should not be construed as limiting of the present disclosure.

Figure 1:
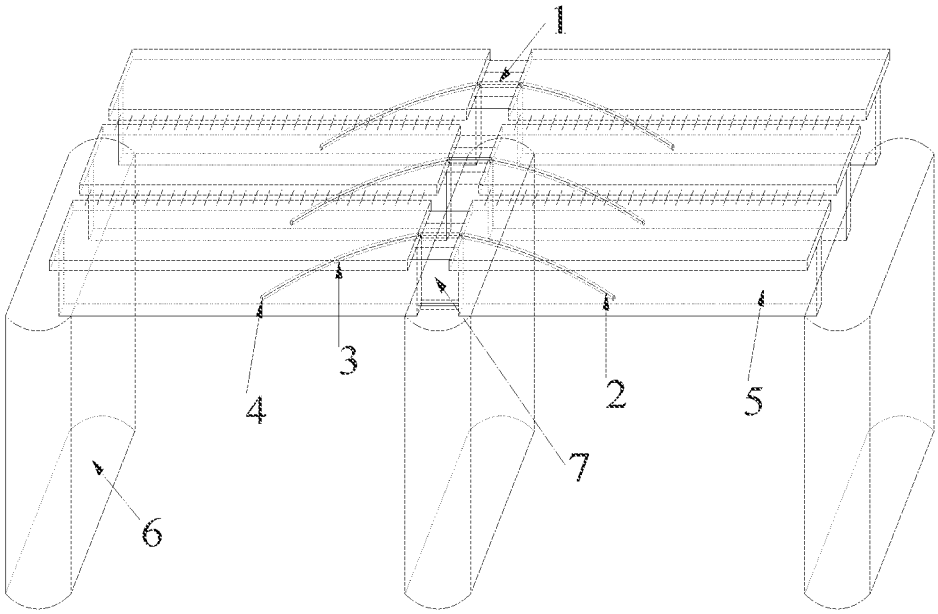
FIG. 1 is a schematic diagram of construction of a continuous section at the top of a continuous T-shaped beam bridge pier according to an embodiment of the present disclosure.

FIG. 1 is a schematic diagram of construction of a continuous section at the top of a continuous T-shaped beam bridge pier. Two T-shaped beams that are continuously connected are disposed on a bridge pier 6, where a connected portion of the two T-shaped beams is a continuous section 7 at the top of the pier, corrugated pipes 3 are disposed inside the T-shaped beams located at left and right sides of the continuous section 7, steel strands 2 are disposed in the corrugated pipes, and an anchor head 4 is disposed on an end portion of one of the corrugated pipes. The corrugated pipes in the left and right T-shaped beams are connected through a corrugated pipe connection device 1 provided by an embodiment of the present disclosure, in place of connecting the corrugated pipes in the two T-shaped beams through another corrugated pipe conventionally.

Figure 2:
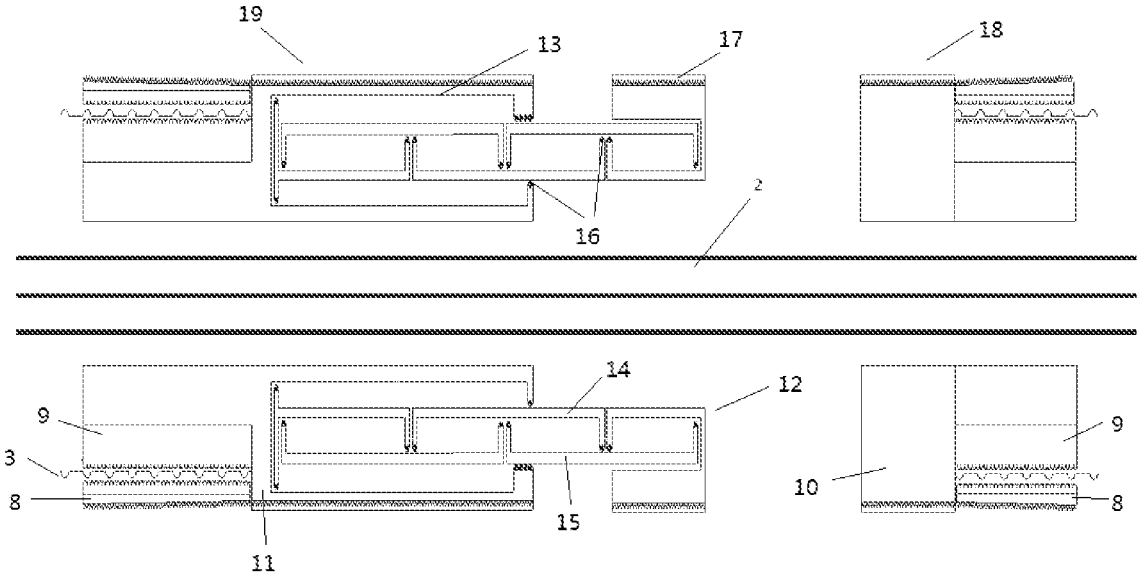
FIG. 2 is a cross-sectional view of a corrugated pipe connection device according to an embodiment of the present disclosure.

As shown in FIG. 2, a corrugated pipe connection device for a continuous section at the top of a continuous T-shaped beam bridge pier disclosed in an embodiment of the present disclosure mainly includes two parts: a corrugated pipe connector 18 and a combined steel pipe telescopic device 19. The device replaces a corrugated pipe between original two continuous T-shaped beams, thereby avoiding problems such as corrugated pipe breakage and slurry leakage caused by an original construction mode. The corrugated pipe connector 18 is connected to a corrugated pipe of one of the continuous two T-shaped beams, the combined steel pipe telescopic device 19 is connected to a corrugated pipe of the other T-shaped beam, and interiors of the corrugated pipe connector 18 and the combined steel pipe telescopic device 19 are hollow, and may be used for stranding steel strands. The combined steel pipe telescopic device 19 may be connected to the corrugated pipe connector 18, and a spacing between the combined steel pipe telescopic device 19 and the corrugated pipe connector 18 may be manually adjusted, and is used for placing a stranding machine to strand the steel strands.

Further, as shown in FIG. 2, in this embodiment, one end of the corrugated pipe connector 18 connected to the corrugated pipe is configured as a first clamping member used for clamping a wall surface of the corrugated pipe, and the clamping member mainly includes a first contact member 8 and a second contact member 9, where the first contact member 8 is in contact with an outer wall of the corrugated pipe 3, and the second contact member 9 is in contact with an inner wall surface of the corrugated pipe. In this way, a clamping force between the first contact member 8 and the second contact member 9 is used for connecting to the corrugated pipe. To increase the tight contact between the first clamping member and the corrugated pipe, an outer wall surface of the first contact member 8 is provided with an external thread; and a diameter of the first contact member 8 in a direction close to the corrugated pipe gradually increases. It should be noted that, in this embodiment, one end of the first contact member which has a smaller diameter is connected to the second contact member 9. The first contact member is made of a plastic material, and the second contact member is a rigid body. In addition, a first rotating nut 10 is disposed on an outer wall of the second contact member, and the first rotating nut is fixed on the first contact member. When the corrugated pipe connector starts to be connected to the corrugated pipe, the first rotating nut 10 is located on a leftmost side of the first contact member, and a pipe wall of the corrugated pipe is placed between the first contact member and the second contact member. The first rotating nut 10 is rotated to be gradually close to the connected corrugated pipe, so that a diameter of a rubber ring continuously decreases, and a contact force between the first contact member and the corrugated pipe increases. Therefore, the friction gradually increases and the connection tightness is improved.

Certainly, in some embodiments, to increase the friction between the first contact member 8 and the corrugated pipe and between the second contact member 9 and the corrugated pipe, in consideration of an actual shape of the corrugated pipe, in this embodiment, an inner wall surface of the first contact member 8 and an outer wall of the second contact member 9 are provided with some protrusions, to match circular grooves on the wall surface of the corrugated pipe. For example, the outer wall surface of the second contact member 9 is configured with raised rubber pellets, and the rubber pellets are tightly attached to an inner side of the corrugated pipe, to increase the friction between the second contact member and the corrugated pipe. In addition, an inner side of the first contact member 8 is configured as foam with raised particles, and the foam particles on the inner side function to increase the friction. In this way, the raised rubber pellets on the outer wall surface of the second contact member 9 and the foam with the raised particles on the inner side of the first contact member 8 function together, to improve the friction between the first contact member 8 and the corrugated pipe and between the second contact member 9 and the corrugated pipe, and ensure the connection tightness between the first clamping member and the corrugated pipe.

As shown in FIG. 2, in this embodiment, one end of the combined steel pipe telescopic device 19 connected to a corrugated pipe in a length direction is also configured as a second clamping member with the same structure as the first clamping member in the corrugated pipe connector, and the second clamping member also includes a first contact member in contact with an outer wall surface of the corrugated pipe and a second contact member in contact with an inner wall surface of the corrugated pipe. An outer wall surface of the second clamping member is provided with the same external thread, and the structure herein is the same as that of the corrugated pipe connector, so that no more details are described. Similarly, a diameter of an outer surface of the first contact member gradually decreases in a direction of the corrugated pipe, and the first contact member is provided with a matching second rotating nut 11.

Further, in this embodiment, the other end of the combined steel pipe telescopic device in the length direction is configured as a telescopic steel pipe 12 which is telescopic in the length direction, and the telescopic steel pipe 12 may stretch out and draw back to adjust a distance between the telescopic steel pipe 12 and the corrugated pipe connector, and may be connected to the corrugated pipe connector located on the other side.

Specifically, in the combined steel pipe telescopic device of this embodiment, one end of the second rotating nut 11 away from the corrugated pipe is provided with an annular groove 13 having a specific length, and the annular groove may be used for placing a sliding pipe. As shown in FIG. 2, the annular groove may be used for accommodating a specific number of sliding pipes, and cross sections of the sliding pipes in the length direction are two U-shaped grooves with vertical openings at upper and lower sides, and are specifically classified into two types: opening directions of two U-shaped grooves on cross sections of a first type of sliding pipes are faced, and opening directions of two U-shaped grooves on cross sections of a second type of sliding pipes are opposite. The first type of sliding pipes 14 form the U-shaped grooves with inner wall surfaces of the sliding pipes through bent plates disposed on both ends of the sliding pipes, and the second type of sliding pipes 15 form the U-shaped grooves with outer surfaces of the sliding pipes through bent plates disposed on both ends of the sliding pipes. The two types of sliding pipes match each other to achieve nested connection, and the connection manner is as follows: The first type of sliding pipes 14 move on side walls of the U-shaped grooves inside the sliding pipes, and move in the U-shaped grooves on the outer surfaces of the second type of connected sliding pipes 15, to achieve connection of the two types of sliding pipes. According to the manner, a plurality of sliding pipes connected to each other may form the telescopic steel pipe. Certainly, a sliding pipe located in an innermost position of the annular groove may slide on upper and lower surfaces of the annular groove at the same time and is used for supporting the entire telescopic steel pipe 12, and is in contact with the telescopic steel pipe at an outlet of the annular groove.

It should be noted that, in this embodiment, a pulley or roller 16 may be disposed on an end portion of a side wall of a U-shaped groove of each sliding pipe, i.e., a portion in contact with an adjacent sliding pipe. Similarly, the same pulley or roller is disposed on a position at which the sliding pipe located in the innermost position of the annular groove in the telescopic steel pipe is in contact with the upper and lower surfaces of the annular groove, and a position at which the annular groove is in contact with the sliding pipe. In this way, smooth sliding among the sliding pipes is achieved. Certainly, in some other embodiments, the pulley or roller may not be disposed, and it only relies on sliding, which can also simplify the structure.

The combined steel pipe telescopic device 19 in this embodiment can adjust the distance between the combined steel pipe telescopic device 19 and the corrugated pipe connector 18, to place a stranding machine to perform stranding. Further, in this embodiment, an external thread 17 is disposed on an outer surface of a sliding pipe located on a rightmost side of the combined steel pipe telescopic device 19, i.e., an outer surface of a sliding pipe close to the corrugated pipe connector. When the sliding pipe slides to the corrugated pipe connector, the external thread of the sliding pipe matches an internal thread of the first rotating nut 10 on the corrugated pipe, so that the corrugated pipe connector is connected to the combined steel pipe telescopic device.

Certainly, in some embodiments, another manner is alternatively used, for example, the sliding pipe close to the corrugated pipe connector and the first rotating nut are connected through a buckle or a third connection member.

Therefore, the corrugated pipe connection device disclosed in the above embodiment achieves connection of corrugated pipes in two continuous T-shaped beams in the prior art, in place of relying on one corrugated pipe to connect the corrugated pipes in the two continuous T-shaped beams in the prior art. The device resolves the technical problem of slurry leakage caused by some pressure produced by grouting due to the poor sealing performance of the tape when the tape is used to seal cutting openings.

In addition, some other embodiments of the present disclosure further disclose a usage method for the corrugated pipe connection device for a continuous section at the top of a continuous T-shaped beam bridge pier described above, and the method includes:

step 1: connecting a corrugated pipe connector to a corrugated pipe on a first T-shaped beam end, and adjusting a first rotating member to squeeze a first clamping member, so that the corrugated pipe is tightly connected to the corrugated pipe connector; and connecting a combined steel pipe telescopic device to a corrugated pipe of a second T-shaped beam end corresponding to the first T-shaped beam end, and adjusting a second rotating member so that a second clamping member squeezes the corrugated pipe on the beam for connection;

step 2: contracting a telescopic steel pipe on the combined steel pipe telescopic device according to an operating space required by a stranding machine, and stranding steel strands at the top of a pier by using the stranding machine;

step 3: pulling the combined steel pipe telescopic device, to connect a steel pipe of the combined steel pipe telescopic device close to the corrugated pipe connector to the corrugated pipe connector; and step 4: tensioning the steel strands, anchoring anchor heads on the corrugated pipe, and finally grouting.

The usage method for the corrugated pipe connection device for a continuous section at the top of a continuous T-shaped beam bridge pier disclosed in this embodiment is simple in operation, and fast in construction efficiency. No operator is required to cut a reserved corrugated pipe on site, and a stranding machine is used to operate on an erected T-shaped beam. After steel strands are stranded, a tape is used to seal cutting openings.

The specific implementations of the present disclosure are described above with reference to the accompanying drawings, but are not intended to limit the protection scope of the present disclosure. A person skilled in the art should understand that various modifications or deformations may be made without creative efforts based on the technical solutions of the present disclosure, and such modifications or deformations shall fall within the protection scope of the present disclosure.

What is claimed is:

1. A corrugated pipe connection device for a continuous section at the top of a continuous T-shaped beam bridge pier, comprising a combined steel pipe telescopic device and a corrugated pipe connector, wherein interiors of the combined steel pipe telescopic device and the corrugated pipe connector are hollow;

the corrugated pipe connector comprises a first clamping member used for clamping a wall surface of a corrugated pipe; and one end of the combined steel pipe telescopic device in a length direction is configured as a second clamping member with the same structure as the first clamping member; an other end is configured as a telescopic steel pipe which is telescopic in the length direction; and the telescopic steel pipe is connected to the corrugated pipe connector.

2. The corrugated pipe connection device for a continuous section at the top of a continuous T-shaped beam bridge pier according to claim 1, wherein the first clamping member comprises a first contact member in contact with an outer wall surface of the corrugated pipe and a second contact member in contact with an inner wall surface of the corrugated pipe.

3. The corrugated pipe connection device for a continuous section at the top of a continuous T-shaped beam bridge pier according to claim 2, wherein an inner wall surface of the first contact member is configured as foam with raised particles; and an outer wall surface of the second contact member is configured with raised rubber pellets.

4. The corrugated pipe connection device for a continuous section at the top of a continuous T-shaped beam bridge pier according to claim 2, further comprising a first rotating member disposed on an outer wall surface of the first contact member and configured to increase a contact force between the first contact member and the outer wall surface of the corrugated pipe.

5. The corrugated pipe connection device for a continuous section at the top of a continuous T-shaped beam bridge pier according to claim 4, wherein an outer surface of the first contact member is provided with an external thread; the first rotating member is a rotating nut; and a diameter of the first contact member in a direction close to the corrugated pipe gradually increases.

6. The corrugated pipe connection device for a continuous section at the top of a continuous T-shaped beam bridge pier according to claim 2, wherein the first contact member is a flexible body; and the second contact member is a rigid body.

7. The corrugated pipe connection device for a continuous section at the top of a continuous T-shaped beam bridge pier according to claim 1, wherein the telescopic steel pipe comprises a plurality of sliding pipes nestedly connected to each other in the length direction; and the sliding pipes stretch out and draw back through rolling of rolling members.

8. The corrugated pipe connection device for a continuous section at the top of a continuous T-shaped beam bridge pier according to claim 7, wherein cross sections of the sliding pipes in an axial direction are two U-shaped grooves with vertical openings; and the rolling members are disposed on end portions of two vertical side walls of the U-shaped grooves.

9. The corrugated pipe connection device for a continuous section at the top of a continuous T-shaped beam bridge pier according to claim 7, wherein a sliding pipe located on an end portion of the telescopic steel pipe is connected to the corrugated pipe connector.

10. A usage method for the corrugated pipe connection device for a continuous section at the top of a continuous T-shaped beam bridge pier top according to claim 1, comprising:

step 1: connecting a corrugated pipe connector to a corrugated pipe on a first T-shaped beam end, and adjusting a first rotating member to squeeze a first clamping member, so that the corrugated pipe is tightly connected to the corrugated pipe connector; and connecting a combined steel pipe telescopic device to a corrugated pipe of a second T-shaped beam end corresponding to the first T-shaped beam end, and adjusting a second rotating member so that a second clamping member squeezes the corrugated pipe on the beam for connection;

step 2: contracting a telescopic steel pipe on the combined steel pipe telescopic device according to an operating space required by a stranding machine, and stranding steel strands at the top of a pier by using the stranding machine;

step 3: pulling the combined steel pipe telescopic device, to connect a steel pipe of the combined steel pipe telescopic device close to the corrugated pipe connector to the corrugated pipe connector; and step 4: tensioning the steel strands, anchoring anchor heads on the corrugated pipe, and finally grouting.

* * * * *